US006776198B1

(12) United States Patent
Haines et al.

(10) Patent No.: US 6,776,198 B1
(45) Date of Patent: Aug. 17, 2004

(54) MOBILE AUTOMATED BAGGING MACHINE FOR IN BULK MATERIAL

(76) Inventors: Carroll Haines, 20 Carrington St., Avoca, NY (US) 14809; James Othmar Brick, 217 West St., St. Martin, MN (US) 56376

( * ) Notice: Subject to any disclaimer, the term of this patent is extended or adjusted under 35 U.S.C. 154(b) by 0 days.

(21) Appl. No.: 10/313,190

(22) Filed: Dec. 6, 2002

Related U.S. Application Data

(60) Provisional application No. 60/338,403, filed on Dec. 6, 2001.

(51) Int. Cl.[7] ..... B65B 1/20

(52) U.S. Cl. ..... 141/10; 141/11; 141/12; 141/69; 141/71; 141/83; 141/94; 141/313

(58) Field of Search ..... 141/10–12, 69, 141/71–74, 77–80, 83, 94, 95, 231, 114, 313–317, 391; 53/435, 436, 523, 525

(56) References Cited

U.S. PATENT DOCUMENTS 4,653,553 A * 3/1987 Cox et al. ..... 141/114
5,155,975 A * 10/1992 Knowler ..... 53/513
5,452,562 A * 9/1995 Cullen ..... 53/428
6,207,228 B1 3/2001 Hundt et al.

* cited by examiner

*Primary Examiner*—Gregory L. Huson
*Assistant Examiner*—Peter deVore
(74) *Attorney, Agent, or Firm*—M. Paul Hendrickson

(57) ABSTRACT

A mobile bulk materials bagging machine equipped to convert compacted bulk materials into baggable material of uniform consistency. The bagging machine includes a feed hopper which may be loaded with compacted bulk materials with heavy duty loaders. The bagging machine conducts a series of processing steps for converting compacted bulk material into a restructured material of a more uniform and free-flowing consistency for bagging. The operation of the bagging machine includes partitioning compacted bulk materials into segmented portions, agitating and leveling systems which, in cooperative association with electronic sensors for intermittently terminating the flow of feed materials, prevents excessive product build up and recompaction of the processed material into an unbaggable material.

20 Claims, 13 Drawing Sheets

FIG.11
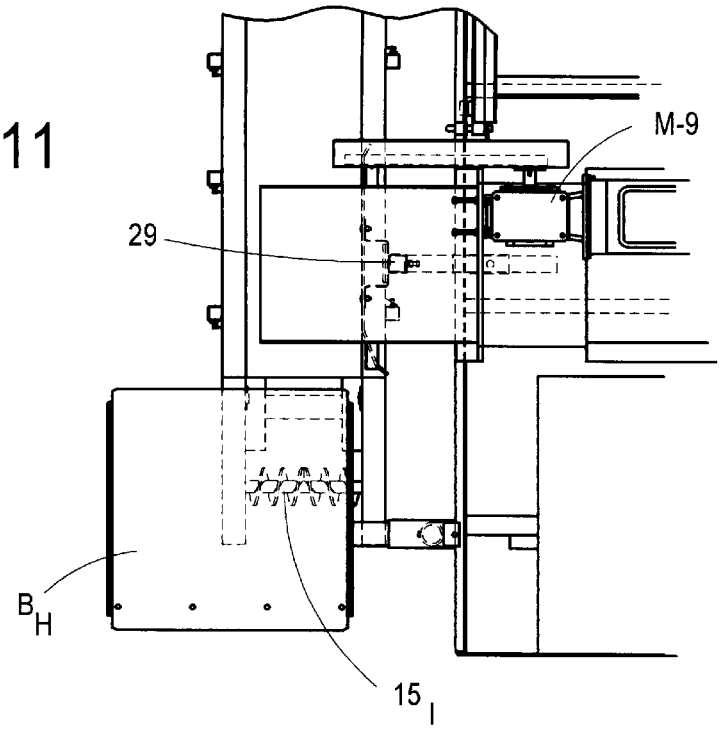
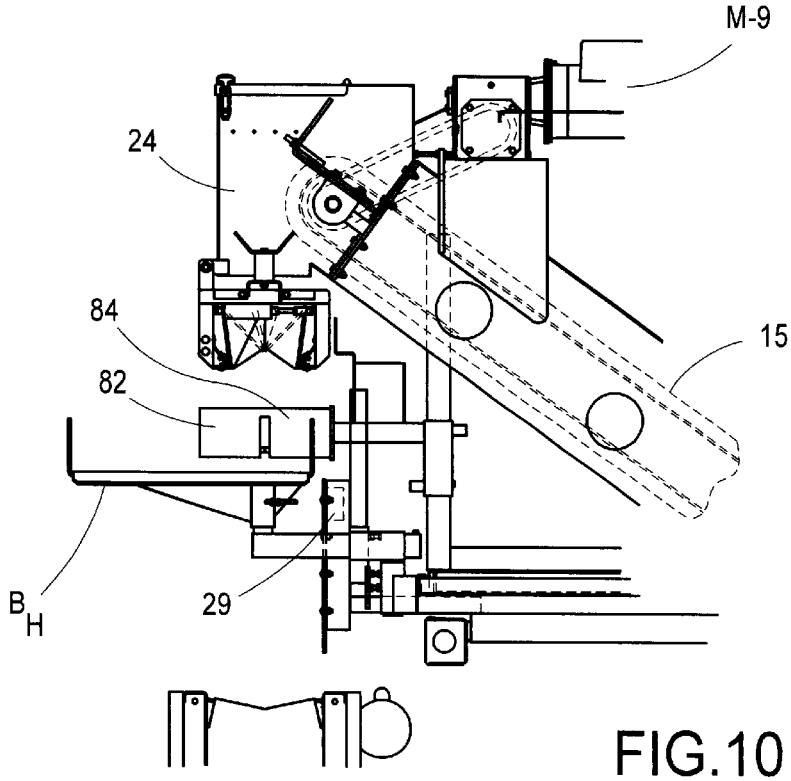
FIG.10

MOBILE AUTOMATED BAGGING MACHINE FOR IN BULK MATERIAL

This application is a non-provisional application of earlier filed provisional application No. 60/338,403 entitled "A Mobile Automated Commodity Bagging Machine", filed on behalf of Carroll Haines, John Stewart, and Jamey Brick on Dec. 6, 2001.

FIELD OF INVENTION

The present invention relates to a bagging machine and, more particularly, to an automated mobile bagging machine, especially useful for bagging compacted bulk materials, and its use.

BACKGROUND OF THE INVENTION

Fragmenting machines for processing in bulk waste materials (e.g. plastics, waste wood products, etc.), into a useful recycled particulated articles or commodities such as disclosed in the U.S. Pat. No. 6,207,228, are capable of producing enormous amounts of processed materials within a short period of time. These processing units are mobile and may be moved from site to site which in turn creates logistical problems in converting these in bulk processed materials into a saleable form. There accordingly exists a need to convert these bulk materials into saleable form such as a bagged product of uniform consistency and bulk weight.

Conventional bagging machines for bagging in-bulk materials are typically immobile and designed to process the bulk materials at a fixed manufacturing site. The handling of the bulk material at the manufacturing bagging site can be effectively controlled so as to ensure bagged product consistency. Specialized transporting systems designed for moving bulk material to the bagging machines and other on-site machinery allows for the bagging of a consistently and uniformly bagged end product at a fixed site of manufacture.

The bagging of vast amounts of in bulk processed materials with mobile processing equipment such as disclosed in U.S. Pat. No. 6,207,228 creates unique off-site bagging problems. The processed products normally require transport to a permanent bagging site for conversion into a saleable bagged product. Unfortunately, the transporting costs often render the manufacturing costs prohibitive.

The off-site bagging problems are further compounded by the on-site equipment utilized to convey the in-bulk materials to a bagging machine. In permanent on-site bagging systems, the handling equipment may be especially designed to deliver the bulk material to the bagging site in an appropriate bagging condition. Off-site bagging system must rely upon available loading equipment such as skid steers, end-loaders, trucks, etc., to transport the material to the bagging unit. Unfortunately, these methods of handling these bulk material compounds the difficulties of bagging the bulk into a saleable product. Less damaging bulk material handling techniques, such as manual handling and forking, are cost prohibitive.

There exists a need to convert recycled in bulk materials at a mobile manufacturing sites into a saleable product form, such as standardized bagged form, at off-site locations using heavy load handling equipment to load the bagging machine bin or hopper. A mobile bagging machine which could be transported from site to site, loaded with heavy loaders and effectively utilized to bag vast amounts of bulk materials as customarily produced by recycling machines such as disclosed in U.S. Pat. No. 6,207,228 would fulfill a long felt need. There also exists a need for portable and automated bagging machines which may be used to bag quickly and effectively large amounts of other bulk materials, such as exemplified by sand bags as used in times of flooding.

SUMMARY OF THE INVENTION

The present invention provides a mobile bagging machine equipped with a hopper or bin for retaining compacted bulk materials for bagging by the bagging machine. The bagging machine hopper is especially designed so that it may be effectively filled or loaded by conventional loading machines such as end loaders, skid steer loaders, etc. The hopper may be suitably of a V-shaped configuration equipped with a bottom fed continuous belt conveyor for feeding controlled amounts of bulk material onto a bagging head conveyor which, in turn, feeds a monitored level of decompacted (meaning more baggable and free-flowing) bulk material to a bagging unit for bagging. The bagging operation is designed so as to automatically stop the bag filling when a bag fill sensor senses that the bag has been filled to a desired level of fill. A new bag may then be inserted for filling. A cross conveyor transports the filled bags from the automated bag filler to a bag closure section which, in the case of thermoplastic bags, includes heat sealing mandrels for heat sealing the bag closure.

In its basic mode of operation, the bagging machine receives the bulk material in a compacted bulk form, partitions the compacted bulk material into segmented portions, subjects the segmented portions to turbulent impinging or fluffing flow so as to decompact the segmented portion, further reduce its bulk density and/or enhance its free-flowing characteristics, levels the turbulized impinged or fluffed segmented portion and conveys it to a bagging unit for uniform bagging. The bagging machine can effectively be utilized to bag a wide variety of bulk materials, including bags filled with sand, insulation, sawdust, mulch, recycled plastics, wood products, ground glass, etc. The bagging machine is portable and sized so that it may be moved by highway to various different bagging sites.

The bagging machine includes an electronic circuitry equipped with sensory devices designed to detect excessive build-up and compaction of product during processing and stop the feed material flow so as to prevent recompaction of product. The bagging machine includes a product level sensor which senses when excessive feed material is fed to surge zone serviced by a product distribution beater and leveling auger so as switch off the flow of feed material and avoid recompaction of processed material fed to the bagger head conveyor and thereafter commences operation when the product level sensor subsequently detects a low supply of feed material within the surge zone. An adjustable capacitative sensor (adjustable to a desired bag fill level) senses achievement of a desired bag fill density level and thereupon automatically closes automatic jaws for holding and filling unfilled bags and switches off the power supply to stop the entire flow of feed material to the bagger head conveyor and the leveling auger.

The over-all operation of the bagging machine may be accomplished by conveying the compacted bulk material stored in a hopper to product separator beater which divides the compacted bulk material into segmented portions which are then allowed to fall onto toothed product distribution beater equipped with spiked teeth which serves to fluff and separate (e.g. decompact the material falling onto the spiked teeth) and a leveling auger operating in a reverse augering direction of feed flow relative to the directional movement of the bagger head conveyor belt towards a bagging unit. The spike toothed section impinges upon contact against the gravitational falling segmented portion, beating against the segmented portion creating a turbulent flow which beats or fluffs the segmented portion into smaller material aliquots generally of a lesser or lighter bulk density. The spiked teeth break apart the segmented portions and fluff it into a less compacted product of enhanced flow characteristics. A leveling auger rotating about a common inclined axis or shaft with a beater evenly level the decompacted product for distribution onto a bagger head conveyor. The processed bulk product is of a more uniform consistency possessing enhanced flow characteristics and reduced bulk density and thereby in suitable condition for bagging by the bagging unit.

BRIEF DESCRIPTION OF THE DRAWINGS

FIG. 10 is an enlarged side view a bagging end of the bagging machine depicted in FIG. 3.

FIG. 11 is a top view of FIG. 10.

DETAILED DESCRIPTION OF THE INVENTION

Figure 1:
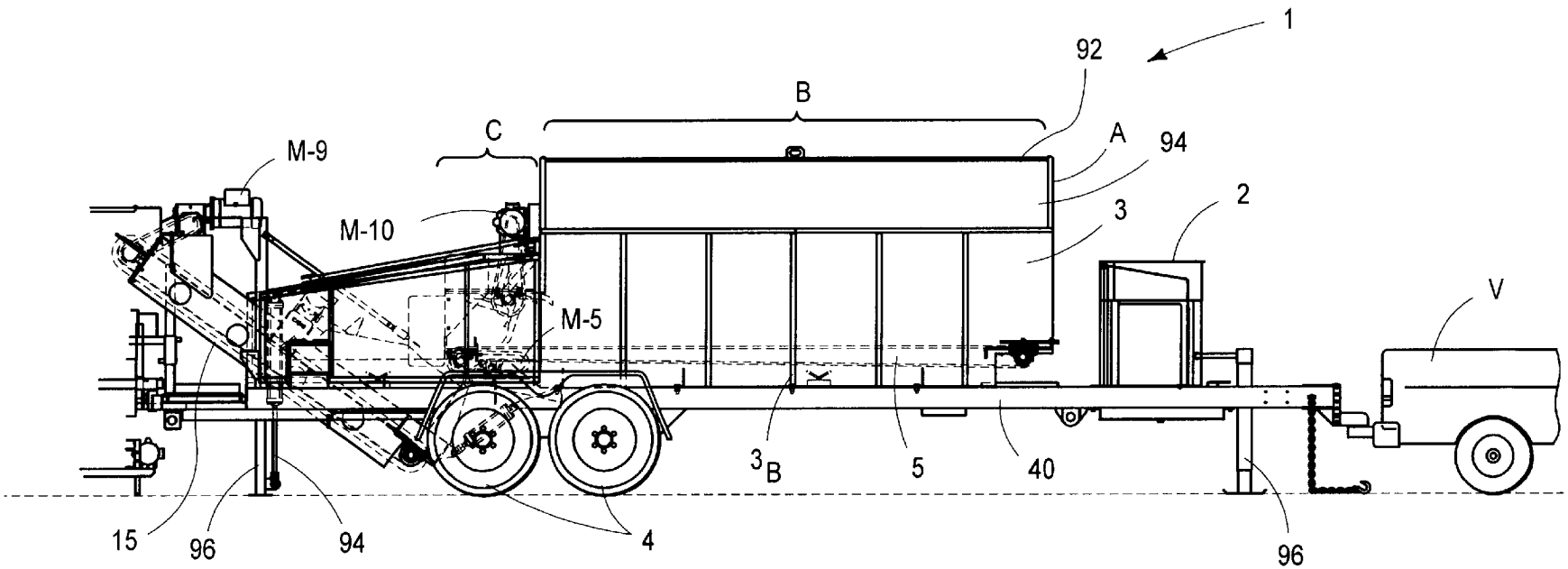
FIG. 1 is a side view of the bagging machine of this invention depicted in transport with a vehicle with phantom lines depicting certain internal components parts of the machine.
Figure 9:
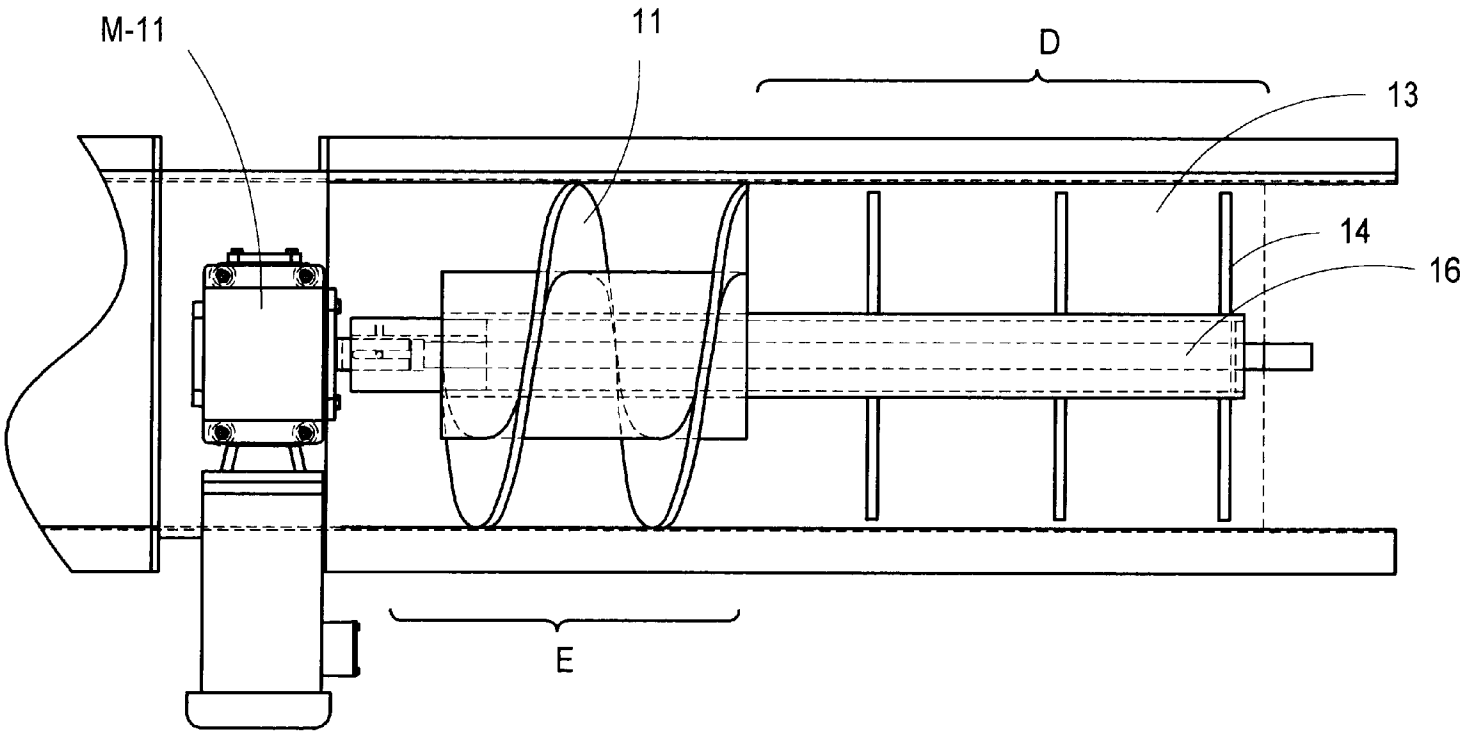
FIG. 9 is an enlarged partial top view of a leveling auger, beater and a bagger head conveyor shown in FIG. 6.

Referring to the Figures, the present invention provides a bagging machine 1 for converting bulk materials into a more uniform free-flowing and baggable product. The bagging machine 1 comprises:

a) a bin 3 for retaining bulk materials, (referenced by zone designated as A in FIG. 1)

b) a bottom conveyor 5 for advancing the bulk materials to a bin discharge end 7, (referenced by zone designated by a B in FIG. 1)

c) a partitioning separator 9 positioned at the discharge end 7 of the bottom conveyor 5 for partitioning the bulk material advancing upon said bottom conveyor 5 into segmented portions, (referenced as a zone designated by a C in FIG. 1)

d) a distributing separator beater positioned in a surge zone (a zone as referenced by D in FIGS. 6 & 9) for beating the segmented portions discharged from the bottom conveyor 5 into a beaten material possessing enhanced flow characteristics, e) a conveyor leveling member 13 for uniformly distributing the beaten material onto a bagger conveyor 15 for transporting the uniformly distributed beaten material for bagging, (referenced by zone designated by E in FIGS. 6 & 9) and f) a bagging unit 17 for receiving the uniformly distributed beaten material from the bagger conveyor 15 and bagging the beaten material in a bag. (generally covering a zone designated by an F in FIG. 6)

Figure 6:
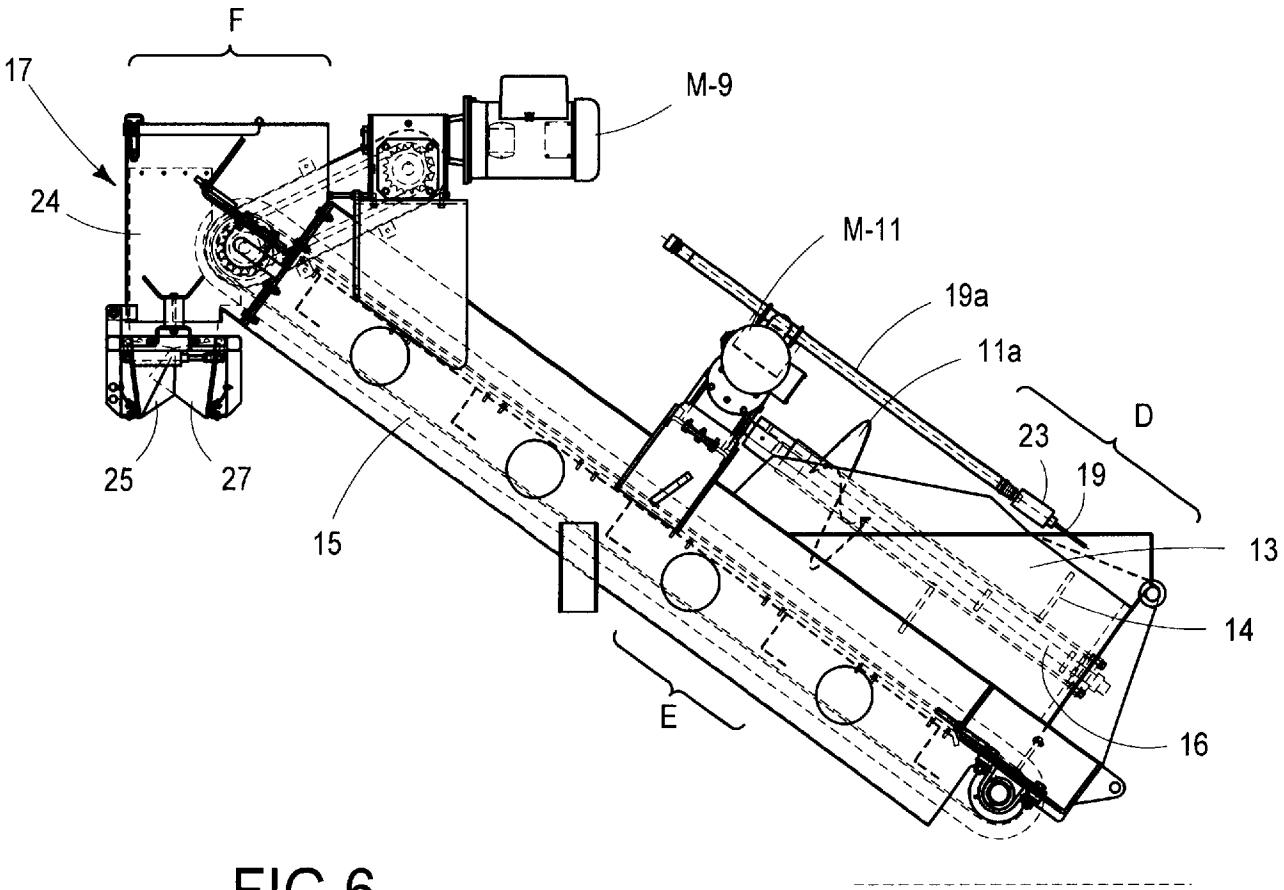
FIG. 6 is an enlarged cross-sectional side view depicting certain working components including a bagger head conveyor of the bagging machine shown in FIG. 3.
Figure 7:
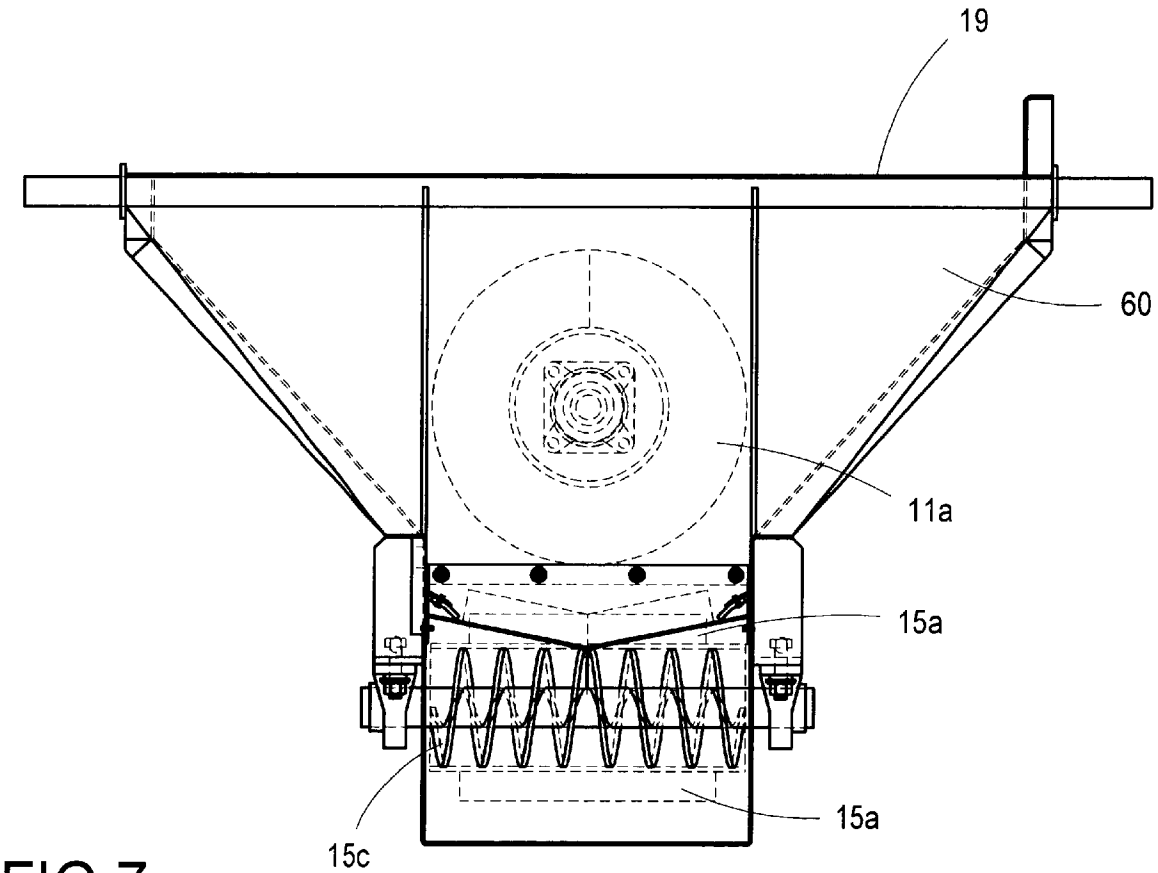
FIG. 7 is a partial end view of a bagger head conveyor shown in FIG. 6 with broken lines showing occluded components.

The surge zone D includes a product level sensor 19 as shown in FIG. 6 for sensing excessive levels of the segmented portions within the surge zone D and preventing a recompacting of the beaten material. The product level sensor 19 is supported upon a supporting rod 19*a* which may be downwardly adjusted to adjustably decrease the amount of material within the surge zone D and upwardly to increase the material level before triggering the leveling sensor 19. Sensor 19 is operationally connected to a switch 23 for stopping the advance of bulk materials upon bottom conveyor 5 when the product level sensor 19 senses the excessive levels of the segmented portions within surge zone D. The product leveling sensor is preferably designed also to switch 23 and stop the partitioning separator 9. The product level sensor 19 is designed to switch the bottom conveyor 5 and the partitioning separator 9 to an operative mode when the product level sensor 19 detects an absence of the excessive levels of the segmented portions in the surge zone D. As shown in FIG. 7, the surge zone D is housed within a trough shaped housing 60 troughing onto bagger conveyor belt 15*a* belted about idling auger 60 which serves to clean the belt and as an idle roller.

Figure 8:
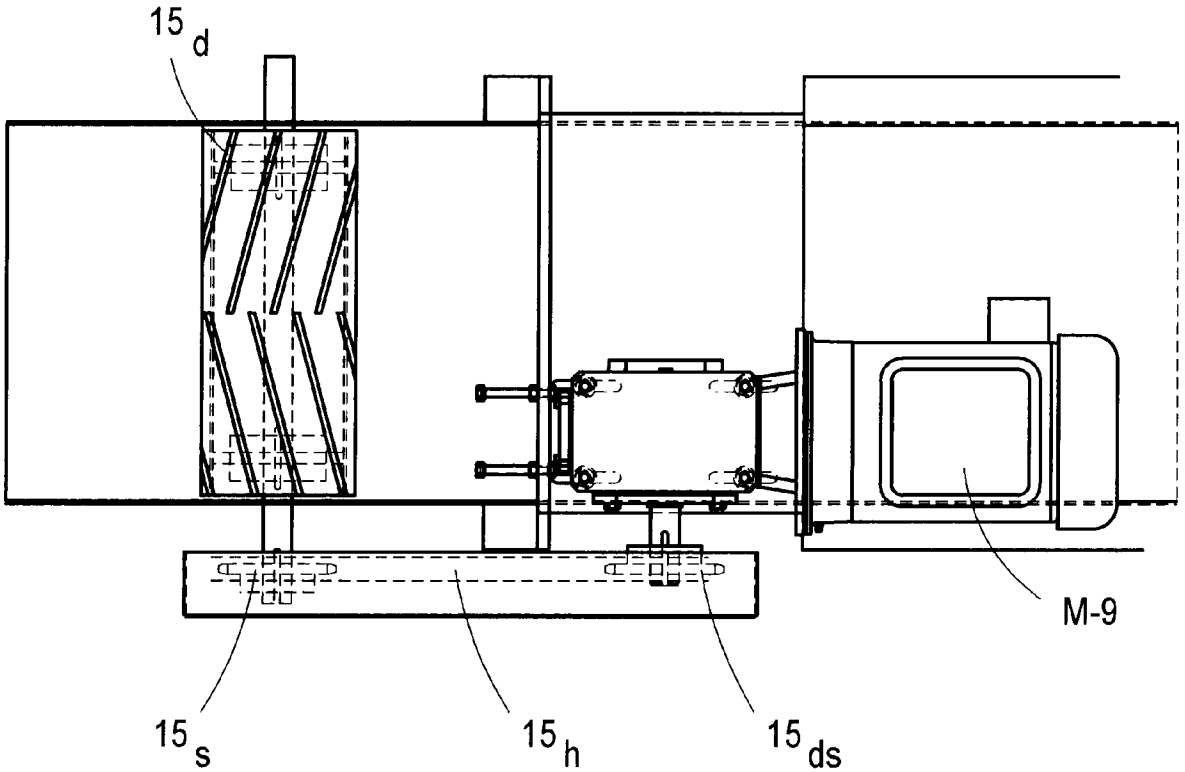
FIG. 8 is an enlarged top view of the discharge end of the bagger head conveyor shown in FIG. 6.

FIG. 8 discloses the chain drive for system for bagger conveyor 15 typically used for the drives utilized to drive the machine 1. As will observed, drive sprocket 15*ds* hains chain 15*h* about driven sprocket 15*g* which drives the driven roller 15*d* about which bagger conveyor belt 15*a* is driven.

Figure 12:
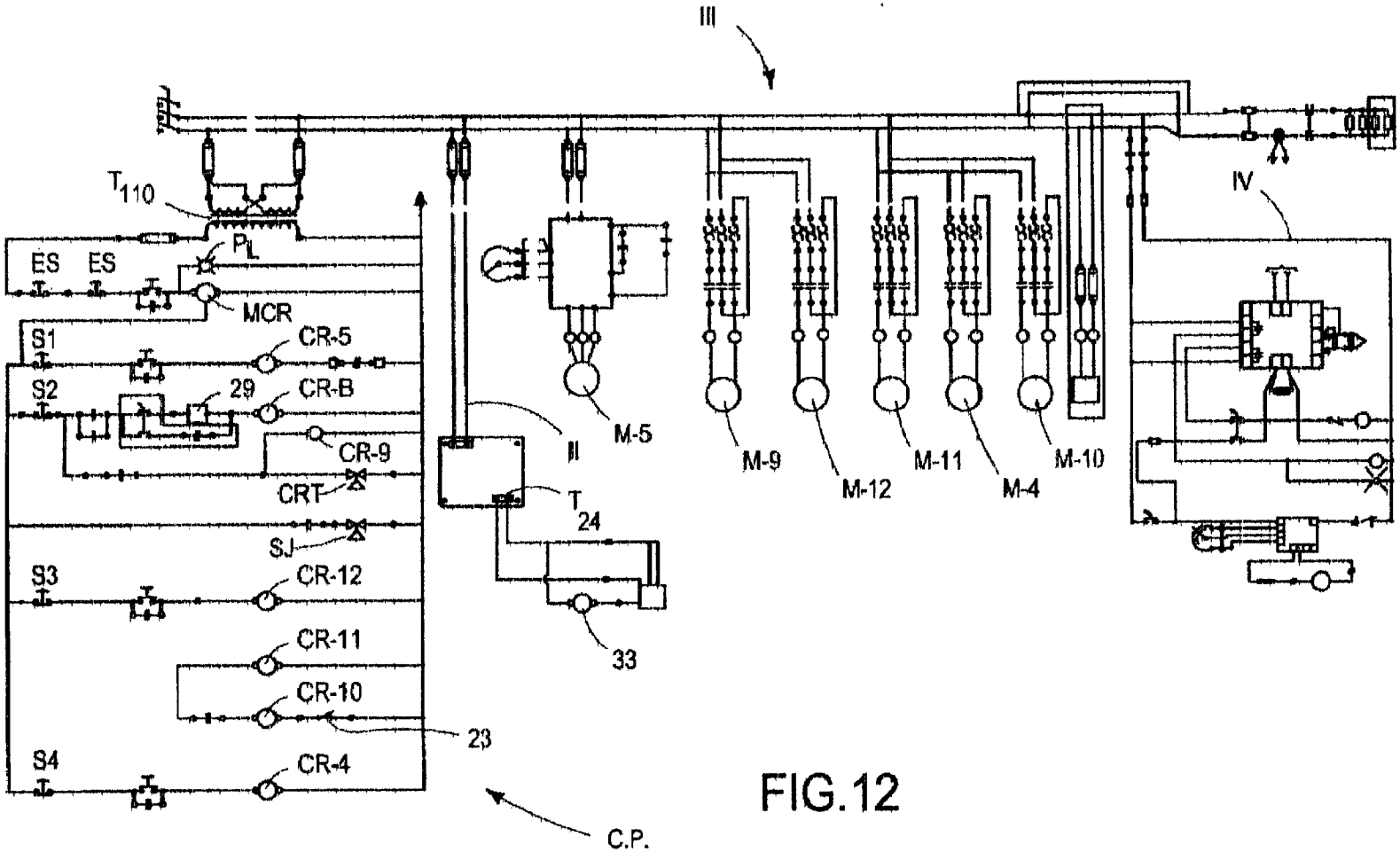
FIG. 12 is an electronic schematic drawing of the electrical circuitry utilized in the bagging machine.
Figure 13:
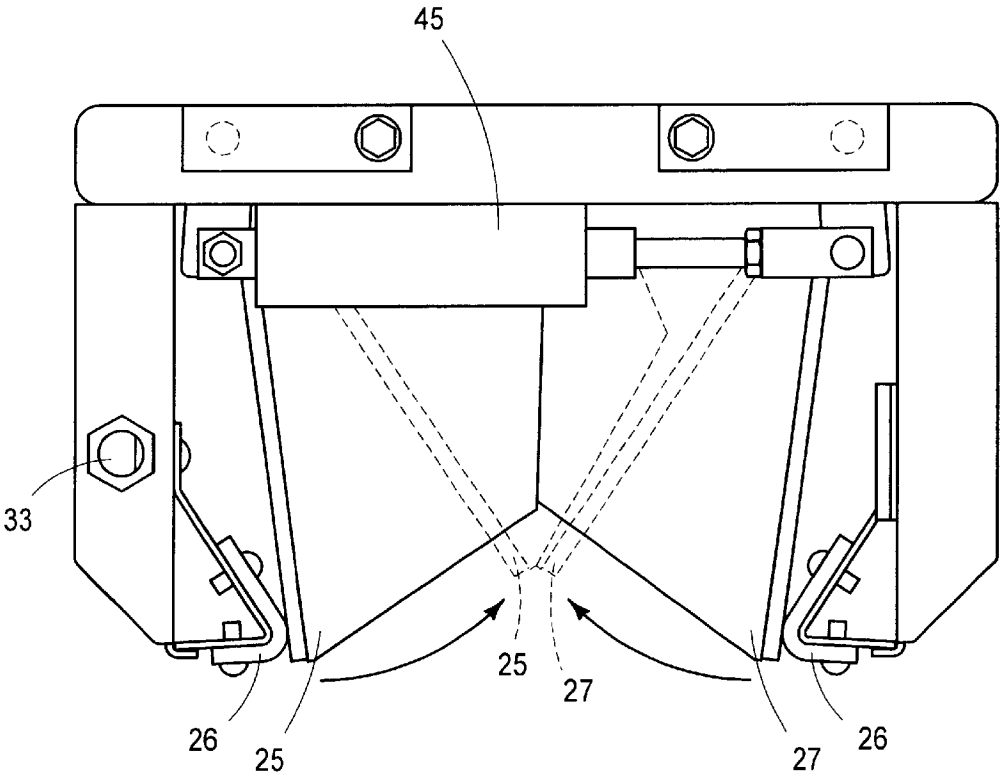
FIG. 13 is an enlarged partial side view of photo electric sensor for closure of the depicted jaw members in FIG. 10.
Figure 13:
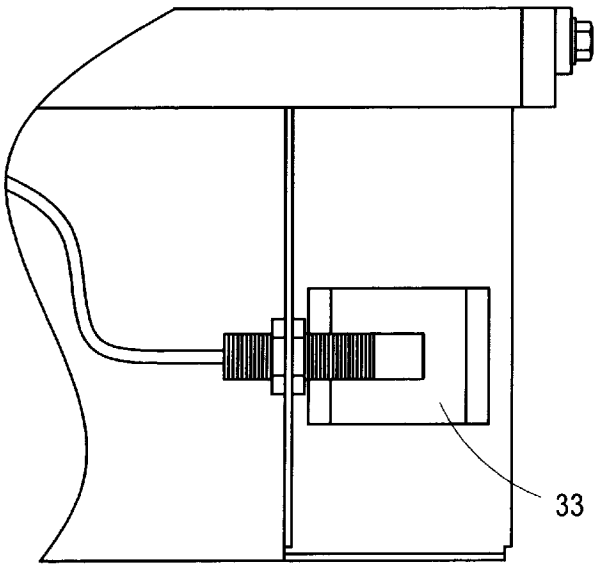

The bagging unit 17 also includes a bagging chute 24 terminated by a pair of laterally disposed jaw members 25 & 27 activated by a closure sensor 29 and an opening sensor 33 which when positioned in a closed position (as shown by the broken line of FIG. 13) serve as a valve to stop the flow of beaten material therethrough and when placed in an open position serve to retain an unfilled bag in a filling position and allow filling of the bag as best shown in FIG. 13. A bag fill sensor 29 which senses when the unfilled bag attains a desired level of bag fill transmits an electronic signal through the circuitry of CP to activate closure of the jaw members 25 & 27 to the closed position. The electronic signal transmitted by the bag fill sensor 29 most appropriately includes a signal relay 31 to switch the bagger conveyor 15 to an off position and thereby stop the transporting of the beaten material to the bagging chute 24. The bagging unit 17 also includes a photo electric eye 33 (as a jaw opening sensor) juxtopositioned near the jaw members 25 & 27 for sensing when a newly positioned unfilled bag is positioned about the jaw members 25 & 27 by emitting an electronic command to switch the jaw members 25 & 27 to the open position. The electronic command emitted from the photo electronic eye 33 also designed as shown in FIG. 12 to switch the bagger conveyor to an operative mode. It may be further observed from FIG. 13 that jaws 25 & 27, when open, will bias firmly to the secured unfilled bag between jaws 25 & 27 and the gripping surface (rubber) of bag retaining rails 26.

With further reference to the accompanying Figures, the present invention provides a mobile, automated bagging machine 1 for effectively bagging compacted bulk materials in large amounts at remote locations. As shown in the figures, the mobile bagging machine 1 includes a flat bed trailer 40 equipped with wheels 4 so that it may be vehicular transported by highway to different bagging sites. In the preferred embodiments of the invention as illustrated in the figures, the bagging machine 1 includes a self contained electrical generator 2 for generating the electrical power needed to power and regulate the operation of the bagging machine 1 at the remote bagging site.

The bagging machine 1 converts compacted bulk materials into a baggable bulk material of a lesser bulk density and more uniform bagging consistency. Compaction of the bulk material inherently arises by reason of its bulk storage as well as the equipment typically required to handle these bulk materials at such remote sites. Bulk material compaction renders the material unsuited for bagging into a quality bagged product of a uniform consistency. The bagging machine 1 processes such compacted bulk materials at a high capacity rate into bulk material which can be consistently bagged into a bagged product of a substantially uniform baggable consistency. The bagging machine 1 conducts a number of sequential processing steps which allows it to convert these compacted bulk materials into a substantially free-flowing, baggable product often of a substantially lesser bulk weight than the starting compacted bulk raw material. This allows the compacted bulk material to be bagged in a reproducible and uniform form for sale to the consuming public.

The sequential processing steps conducted by the bagging machine 1 generally involves partitioning a compacted bulk material into segmented portions (zone C), subjecting the segmented portions to turbulent fingering or beating forces (e.g. such as rotating fingers exerting an outwardly pulling action to pull apart the segmented portions, particles or fibrous chips) of zone D to decompact the segmented portion into a more free flowing and decompacted product generally of a reduced bulk density and then conveying the decompacted material to a bagging unit 17 for bagging.

In the depicted embodiments of the invention, the bagging machine 1 includes automated means for delivering a regulated amount of processed bulk material (zones B, C, D & E) to a bagger conveyor 15 for feeding to an automated bagging system (designated as zone F) for the filling of bags to an uniform fill. A bag fill sensing means 29 such as adjustable (upwardly and downwardly) capacitive sensor is used to detect a desired density of bag fill and transmit an electronic signal to terminate the flow of material when the desired bag fill is achieved. The filled bag may then be displaced from automated jaws 25 & 27 of bagging unit 17 and zone F and replaced with a new unfilled bag for filling. Alternatively and more expensively, the bagging machine 1 may be modified to include completely automated electronic circuitry (not shown) for sensing bag fill 29 when each bag is appropriately filled, stopping the advance of baggable feed material upon the filling of each bag, automatically sealing the filled bag, advancing a new bag for filling at automatic jaw members 25 & 27 and commencing the flow of feed material to newly attached bag for filling.

The bagging machine 1 operates particularly effectively when the amount of feed material flowing through the bagging machine 1 is regulated by bag fill sensing means 29 and an interruptable bulk material feeding means for regulating the uniformity of feed materials fed through the bagging system. This may be accomplished by effectively controlling or regulating the amount and uniformity of feed material being fed through the bagging-machine. Uniformity in bagged product is generally accomplished by reducing the bulk density of the bulk material so as to impart a more uniform product flow and baggability of the processed end product. In the case of materials of a low bulk density (e.g. wood chips typical of a bulk density of 20–30 pounds/cubic feet), excessive compressive forces deleteriously alter the product density bag fill and product uniformity for bag filling and should accordingly be avoided after the bulk material exits the product separator stage of zone D of the processing. In general, most granular solids such as sand (90–110 pounds per cubic foot) granulated glass (80–100 pounds for cubic foot) and potash (70 pounds/cubic foot) are also prone to compaction but to a lesser order when handled in bulk and accordingly may none-the-less be effectively bagged with the present bagging machine 1. Sand and potash, when moist, become cohesive and prone to bridging and moldability which the present bagging method converts into a more fee flowing and baggable product. Whatever bulk material is subjected to the bagging process, the processing under the present invention imparts improved free-flowing attributes to the processed material which in turn renders the product more fit for uniform bagging. By sensing the bag fill density and regulating the feed flow throughout the overall processing within the bagging machine 1, excessively damaging bulk density, poor flow characteristics and product non-uniformity may be avoided in the processed end product. Excessive feeding without regulating compaction can result in excessive weight, excessively filled product density, irregular bag fill and/or damage to the bagged product.

In the depicted drawings, subjecting of the segmented portions to the beating action involves rolling and mixing the segmented portions about a beater 13 equipped with toothed projections 14 radially moving about an axis positionally disposed so as to outwardly roll and mix the segmented portions fed onto the toothed projections 14. Surge zone D includes allowing the segmented portions to gravitationally flow onto the beating action of beater 13. The surge zone D is equipped the product level sensor 19 for detecting an excessive surge of segmented portions within the surge zone D housing the beater 13 for beating the segmented portions. When detecting the excessive surge of segmented portions to said surge zone D, the product level sensor 13 relays an electronic signal to terminate a flow of the segmented portions into the surge zone D. This product level sensor 19 later relays an electronic signal to commence the flow of segmented portions into the surge zone D when it detects an absence of the excessive segmented portions within the surge zone D.

The bagging method includes the use of an adjustable capacitive sensor 29 for sensing bag fill and transmitting an electronic signal to stop the conveyance of the uniformly distributed beaten material upon the bagger conveyor 15 when the adjustable capacitive sensor 29 senses the bag filled to a predetermined level of fill. Said method includes:

a) adjusting the adjustable capacitive sensor 29 to the predetermined level of fill, and b) allowing the bag to be filled to the predetermined level of fill and the transmitting of the electronic signal to stop the conveyance of the uniformly distributed beaten material upon the bagger conveyor 15 to said bagging unit 17.

The method of using the depicted bagging machine 1 contemplates manually replacing the bag filled to the predetermined level with an unfilled bag and restarting the flow of feed materials by switching the automated jaws members 25 & 27 so as to allow the unfilled bag to be filled to predetermined level of fill. A photo electric sensor 33 for sensing placement of an unfilled bag upon a pair of the laterally disposed closed jaw members 25 & 27 for receiving the beaten material from a bagging material chute 24 may be effectively used for this purpose. The jaw members 25 & 27 serve to stop the flow of uniformly beaten and free-flowing material when placed in a closed position and to allow for the filling of a bag and retaining of the unfilled bag in a filling position when positioned in an open position by the electronic circuitry of CP for causing the jaw members 25 & 27 to be placed in the open position when sensing the placement of the unfilled bag upon said jaw members 25 & 27. This is accomplished by placing the unfilled bag upon the jaw members 25 & 27 to cause the photo electric sensor 33 to sense the placement of unfilled bag thereupon and thereby activate the electronic circuitry to place the jaw members 25 & 27 in the open position to bias the bag opening against bag retaining rails 26.

Figure 3:
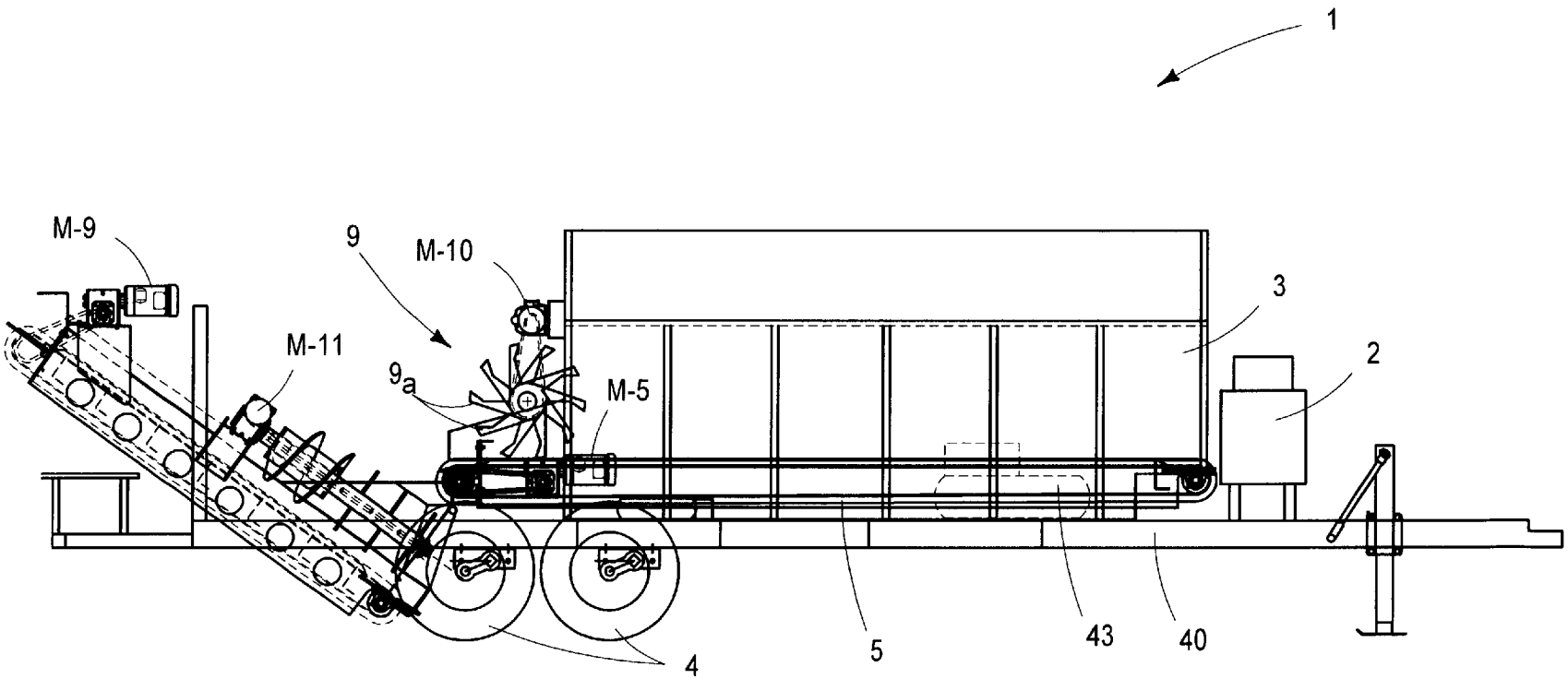
FIG. 3 is a length wise cross sectional view of FIG. 1 depicting in greater detail the internal working components of the bagging machine shown in FIG. 1.

With particular reference to FIGS. 3 and 6, the partitioning separator 9 comprises a plurality of vaned appendages 9*a* equipped with distal separating edges 9*e* (e.g. see FIG. 3) powered about rotating radi which pass through mating apertures 7*a* (shown in FIG. 6) at the bin discharge end of a holding bin 2. The rotating the vaned appendages 9*a* pass through the mating apertures 7*a* into bin 2 to cause the separating edges 9*e* to penetrate, slice and separate the bulk material being conveyed thereto by a bottom bin conveyor into the segmented portions which are carried by the bottom conveyor 5 for dropping into the surge zone D.

The use of the depicted bagging machine 1 includes a leveling member 11 for uniformly distributing the beaten material upon the bagger conveyor 15, it will be observed that the depicted leveling auger 11*a* shares a common axle drive 16 with beater 13 equipped with the toothed projections 14. When engaged, the common axle drive 16 permits the beater 13 to rotationally outwardly roll and beat the segmented portions into beaten material while simultaneously allowing the leveling auger 11*a* to rotationally and uniformly level the beaten material onto the bagger conveyor 15.

Commercial salability demands that the bagged product be uniform in flow character, bag fill, and consistency. The regulatory feed sensing means utilized in the bagging machine 1, as illustrated, maintains a regulated and controlled rate of feed to the bagging unit. This permits the product separator beater 9, product distribution beater 11 and leveling auger 11*a* to deliver consistently uniform processed product for bagging. When the bag fill sensing means 29 detects filling of a bag to the desired bag density level, the bag fill sensing means 29 relays an electronic signal to terminate movement of feed material and further fill, by the closing of the automated jaws 25 & 27 and ceasing the flow of feed material to be processed until the filled bag may be replaced from jaws 25 & 27 with a new bag for filling. The cessation of feed material flow may be effectively accomplished by relaying the electronic signal from the adjustable capacitive sensor 29 through the electronic circuitry as depicted in FIG. 12 to switch off the motor M-9 driving the bagger header conveyor 7. In operation, the automatic jaws 25 & 27 are sized and configured so as to engage onto the bag opening with bag retaining rail 26 and suspend the bag while the bag is being filled. When the adjustable capacitive sensor 29 signals a full bag, the electronic circuitry as depicted by IV in FIG. 12 switches the air source provided by air compressor 43 to pneumatically adjust the pneumatic air cylinders 45 operatively connected to the automatic jaws 25 & 27 to a closed position whereupon the suspended bag is released by the jaws 25 & 27 and drops onto the continuously driven cross conveyor 47 which, in turn, delivers a plastic bag (in the preferred embodiment) for thermal closure with a thermoplastic heat sealing means 49.

As may be visualized from the cross sectional view of FIG. 3, compacted bulk material conveyed or dumped into the holding hopper 3 of zone A is advanced through hopper bin 3 by a continuous belt conveyor 5 (zone B) driven by geared electrical motor M-5 onto a partitioning processing area (zone C) served by a product separator beater 9 which uniformly segregates and distribute the compacted bulk material into segmented portions (separates and partitions) for conveyance by the bin conveyor 5 and further processing within the product surge area of area D.

The product separator beater 9 is appropriately positioned at the discharging end 7 of the hopper conveyor belt 5 as best shown in FIGS. 3 and 13. The material being conveyed by the hopper conveyor 5 is typically a heavily compacted bulk material arising by reason of the compacted manner in which the bulk material is handled and stored in the hopper 3. The depicted product separator beater 9 comprises a plurality of separating legs 9*a* rotationally mounted about axle 9*x* and driven by motor M-10. As will be observed from FIG. 3, the separator beater 9 is positioned at the discharging end 7 of hopper conveyor 5 so as to engage and separate the compact bulk product advanced by hopper conveyor 5 into segmented portions which fall onto the mechanical workings of rotating spiked teeth 14 of product separator beater 13 which serve to comminutate or fluff the segmented portions into a more free flowing product.

As may be observed particularly in FIG. 13, the depicted rotating, separating and biting legs 9*a* of separator beater 9 have a substantially planer aft side 9*b*, a foot section 9*f* with a leading and biting edge 9*e* for penetrating and biting into compacted material conveyed to it by hopper conveyor belt 5 and a receded declining ankle section 9*o* for lifting and separating the bulk material into segmented portions onto hopper conveyor 5 for discharge. Thus it may be visualized from FIG. 13, that as the compacted material advances to the product separator beater 9, the leading beater edges 9*e* biting into the compacted bulk material with the leading or biting edges 9*e* of foot 9*f* with the rotational movement of the product beater separator 9 which lifts the segmented portions upwardly towards receded section 9*o* with the segmented portion being carried to the end of bin conveyor 5 for dropping into surge zone D. The product distribution beater 13 of the product surge zone D commences the most significant decompaction of the compacted bulk material. The separating and biting legs 9*a* rotate into bin 3 through the slotted apertures 7*a* of rear bin wall 7 (e.g. see FIG. 5) to penetratingly cut and pull segmented portions onto bottom conveyor 5 as separator beater 9 is rotationally driven by motor M10.

The segmented portion of zone C discharges from the discharged end of the hopper conveyor 5 into surge zone D. The surge zone D fulfills several important processing steps for placing the bulk material into salable baggable form. The segmented portions gravitationally discharged at the discharge end 7 of hopper conveyor 5 impinges onto product distribution beater 9 which shares a common axial drive 16 with leveling auger 11*a* driven by auger leveling beater motor M-11. The distribution beater 13 comprises a plurality of toothed shafts or projections 14 radially projecting outwardly from the common axle drive 16. As the segmented portions fall onto toothed projections 14 of product distributor beater 13, the segmented portions are further separated by separating forces which rotationally force the segmented portions while exerting outwardly an internal loosening of the bonding forces tending to hold together the segmented portion pieces which further facilitates the separation (especially in case of wood chips or mulch) into a beaten material having enhanced free-flowing properties. This fluffing action by the distributor beater 13 can cause a reduction in product bulk density and generally renders the processed beaten material in a more flowable or free-flowing form substantially more conducive to uniform bagging than the unprocessed compacted bulk material. Since it is important to prevent recompaction of the uncompacted product, the surge area D is equipped with a product level sensor 19 which serves to terminate the flow of segmented portion when surge area D becomes congested with an excessive build-up of materials conducive to compaction.

After the product separator beater 9 and the product distributor beater 11 have converted the feed material to an appropriate processed form for bagging, the product leveling auger 11*a* of surge zone D uniformly deposits the processed beaten material onto bagger header conveyor 15 for conveyance onto the bagger filling area of zone F. The product leveling auger 11*a* creates a gentile back flow of processed product of beaten material for uniformly leveling onto the bagger head conveyor 15. The lateral positioning of the leveling auger 1*a* above the bagger head conveyor 15 and counter augering direction allows the processed product to be uniformly deposited thereupon. This creates a uniform and consistent level of processed product of the beaten material upon the bagger head conveyor 15 which deposits the uniformly processed material at the discharge end of bagger header conveyor 15 onto bag fill area of zone F for uniform bag filling.

It is important that the processed product as it is transported onto automated jaws 25 & 27 of area F at the discharging end of the bagger header conveyor 15 be substantially level and of a substantially uniform and free-flowing consistency so as to permit a uniform bag fill. The depicted bagger head conveyor 15 comprises a continuous conveyor belt 15*a* appropriately driven by a 20:1 geared box powered by a 1750 RPM, 240 volt AC motor M-9 and the product leveling auger 11*a* driven by a 100:1 geared box powered by a 1750 RPM 240 volt AC motor M-11. The bagger head conveyor assembly 15 shown in FIG. 8 includes a drive sprocket 15*ds* for driving chain 15*h* for driving sprocket 15*s* which auger drives rollers 15 about which belt 15*a* is continuously driven. The product leveling auger 11*a* is laterally aligned above the continuous belt 15*a* of the inclined bagger header conveyor 15 and serves to uniformly level the bulk material being transported onto the bag filling area F. The exiting end or feed outlet end of the bagger header conveyor 15 chutes onto bagging chute 24 for discharging bulk material onto automatic jaws 25 & 27 (inner and outer) which are opened and closed pneumatically by air cylinders 53 (as best depicted in FIGS. 10, 11 and 13), the open and bag holding positioning of which is controlled by an adjustable capacitive sensor 29 preset at a desired density of bag fill. Transparent plastic bags placed above a continuously moving bag conveyor 55 with the bag opening engaged onto the automatic jaws 25 & 27 will be continuously filled until bag 7 density (or alternatively and less desirably, a sensor or beamed light) of the capacitive sensor 29 is interrupted by the density of bag fill which, in turn, relays an electronic signal to switch off the flow of beaten material upon bagger conveyor 15 by switching off the bagger head conveyor motor M-9. The filled bag is then laterally moved along the continues belt 55*a* of the cross bag conveyor 55 so as to provide room for an unfilled bag to be repositioned in the filling position beneath the automatic jaws 25 & 27, at which time the operator trips the electronic circuitry of photo electric sensor 33 to the "on" position to open the automatic jaws 25 & 27 to a bag retaining position and to restart the bag filling operation. As may be observed from FIG. 3, the amount or level of bag fill may be regulated by adjusting upwardly or downwardly the adjustable capacitive sensor 29 to any desired bag fill level. The filled bags are laterally moved along the cross conveyor 55 onto a conventional double line heat sealing unit equipped with a thermoplastic air sealer 57 (complete commercially available unit such as manufactured and distributed by Hamer) for sealing the bag openings. The sealed bags are then removed from cross conveyor 55 for future distribution.

Figure 4:
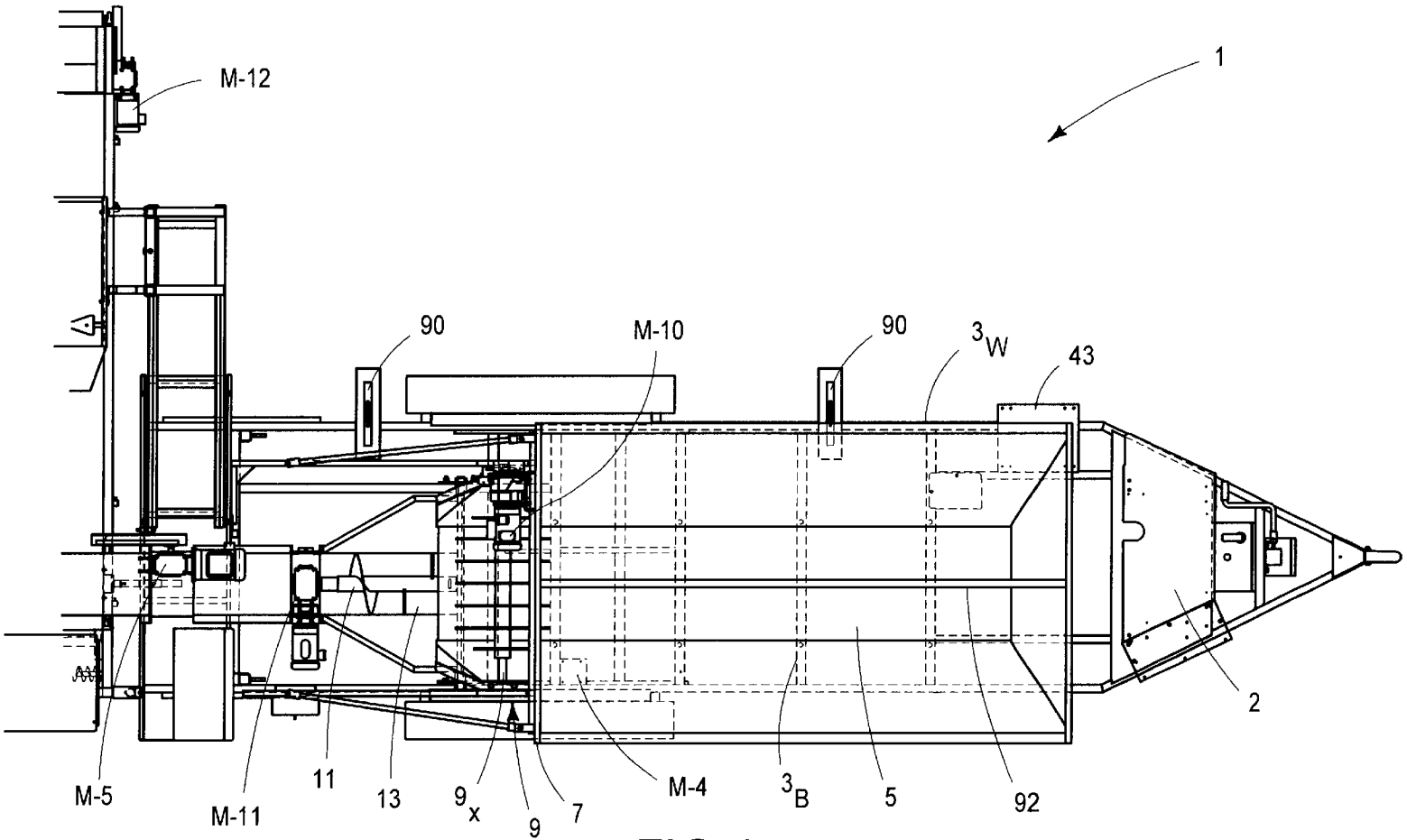
FIG. 4 is a top view of the machine shown in FIG. 1 with the broken lines revealing occluded components.
Figure 5:
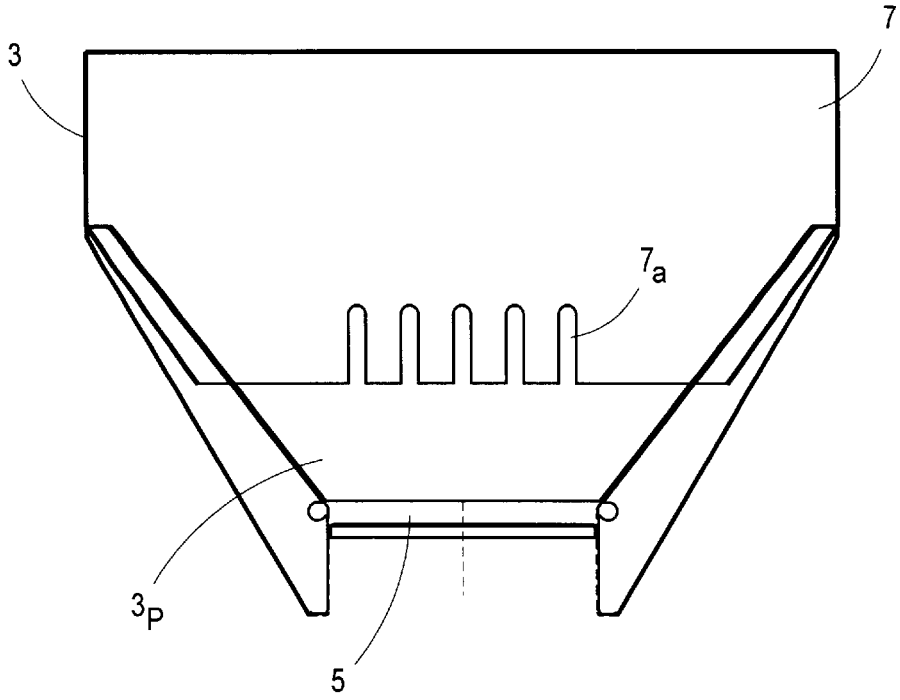
FIG. 5 is a partial rear view of a holding bin of the bagging machine shown in FIG. 1.

With particular reference to FIGS. 3, 4, and 5, the bagging machine operation typically entails filling of holding bin 3 with bulk material to provide a compacted reservoir of bulk materials (area A) to be processed by the bagging machine 1. The bin is constructed of a trough shaped wall panels 3*w* reinforced by support frame beams 3*b* shown as broken lines in FIG. 4 with the discharging wall panel 7 having a discharging port 3*p* through which bottom conveyor 5 extends and slatted apertures 7*a* for entry of separator legs 9*a*. When the bagging machine 1 is running, the compacted material held in hopper 3 in slowly conveyed by bottom conveyor 5 to product separator 9 which evenly removes compacted material from hopper 3 by creating substantially uniform partitioned segments of product. Decompaction and restructuring of the bulk material into a product of lesser bulk density commences at product separator 9 with the segmented portions being conveyed by bottom feed belt conveyor 5 onto surge chute housing.60 which defines the processing entry of segmented portions onto surge zone D. As may be observed leveling auger 11*a* driven by motor M-11 creates a back surge and leveling of product being deposited onto bagger header conveyor 15. The leveling auger 11*a* is longitudinally disposed at an inclined plane lateral and parallel to that of bagger header conveyer 15 with leveling auger 15 auguring the material being processed in an opposite direction of flow from the movement of product upon the bagger header conveyer 15. This levels and uniformly distributes the product upon bagger header conveyor 15 for filling.

The lateral distance or space between the bottom-most edge of auger 11*a* and the interfacing surface of bagger header conveyor 15 is set so as to create a product flow of uniform consistency (e.g. uncompacted for bagging) thus leading to a product of uniform consistency for bagging. The leveling auger 11*a* is axially aligned with and immediately adjacent to a product distribution beater 11 which also rotates in the same direction speed and serves to fluff and decompact the product into an uniform form for bagging.

It is important to maintain the decompacted feed product in its uncompacted state for effective and uniform bagging of the product. The bagging machine 1 is accordingly suitably equipped so as to stop the flow of material if and when conditions conducive for recompaction of the feed material occur at any processing stage of the bagging operation. Compaction will inherently arise by the nature whereby hopper 2 is filled and maintained with material. However, by taking the necessary precautions to stop the flow of material through the bagging machine when compaction is likely to arise, product uniformity in the bagged product may be appropriately maintained. As may be observed, the product level within the product surge area D is maintained and controlled by a surge product level sensor 19 which senses excessive material build-up within the product surge area D and relays a signal to the main panel control for switching and stopping motors M-5 and M-10 respectively for the hopper conveyor belt 5 and the product separator beater 9. This stops the flow and surge of material into the product surge area D until the material feed excesses are corrected. When the product surge area D returns to its normal operational stage, the product level sensor 19 signals the product separator beater 9 and hopper conveyor 5 to commence feeding of segmented portions of material again to the product surge area D.

Recompaction of the material can also arise if a build-up of product arises at the product discharging end of bagging area F. This can arise when the filling of a bag has been completed and a new bag for filling has not been inserted for filling into the line. This problem can be effectively controlled by terminating the flow of the beaten material upon the bagging conveyor 15 when an adjustable capacitive sensor 29 senses a, filled bag and signals the control panel to switch namely the bagger head conveyor motor M-9. Motor M-11, which runs leveling auger 11 and distributing beater 13, will normally be kept running. When a new bag is inserted onto the automatic jaws 25 & 27 in the bag fill area, the photo electric sensor 33 senses the insertion and switches the opening of jaws 25 & 27 so as to commence flow of feed material onto the bagging unit 17.

The manner in which the product separator beater 9 evenly removes compacted bulk material from hopper 2, the manner in which the product surge area D receives, regulates the flow, the controlled working of feed material within the surge area D and stopping the feed material flow when full, the manner in which the distributing beater 13 pulls apart and separates the segmented portions onto beaten material and the leveling auger 11*a* distributes a substantially uniform and consistent layer of bulk material onto the continuous head conveyor belt 15*a* for delivery to bagging chute 24 coupled with the termination of material flow in the over-all bagging process when the bagging operations may be temporarily interrupted by replacement of a new bag for filling are all representative of the unique bagging features and operations conducted by bagging machine 1 to provide a quality bagged product.

The product separator beater 9 of area C creates a uniform and steady feed of flow segmented portions onto the discharging end 7 of the bagger head conveyor 5 which facilitates against down stream bridging. The tilt level control features of zone F starts and stops the bagger conveyor 15 so as to facilitate against compaction while ensuing a flow of material when needed. The product leveling auger 11*a* of zone E levels the processed product being conveyed up the bagger conveyor 15 so as to ensure a steady and uniform feed rate to the bagging unit 17. The bottom section of leveling auger 11*a* extends onto, the projecting beater fingers 14 which continually agitate and roll the processing product to remove cohesive bridging within the worked beaten mass so as to impart the desired free-flowing character needed to effectively bag the end product. In a preferred embodiment of the invention, the bagger header conveyor 15 is equipped to operate at variable speed (drive) which allows for more accurate control and speed of the bagger header conveyor 15 for the various different types of materials being bagged by machine 1. The capacitive sensor 29 (zone E) is fully adjustable (upwardly and downwardly) so to allow for different volumes and densities of bagged materials as well as bag sizes.

Figure 14:
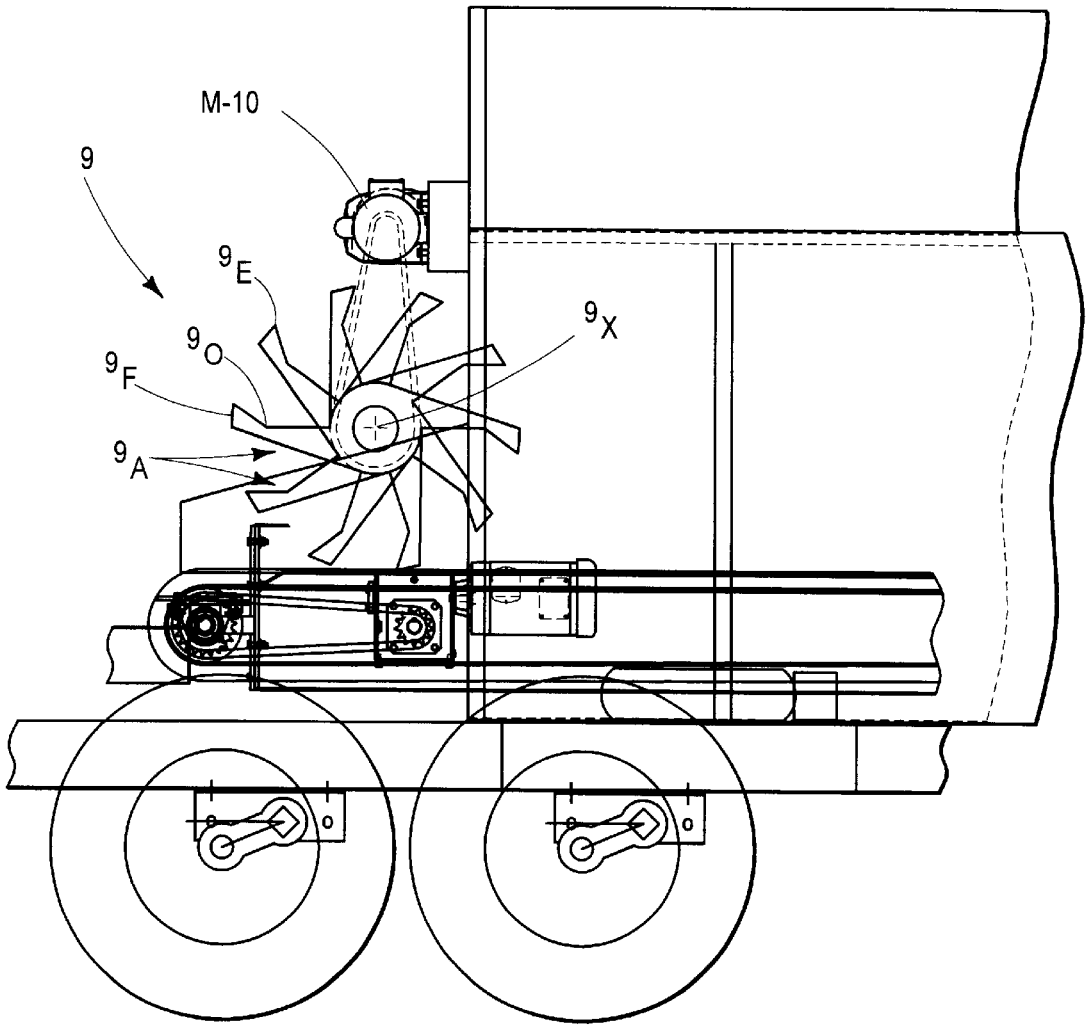
FIG. 14 is an enlarged partial cross-sectional side view of a partitioning separator, holding bin and bottom conveyor shown in FIG. 3.

In the depicted embodiments, the machine 1 is equipped with an air compressor and tank 43 shown by broken lines in FIGS. 1 and 3 for powering air cylinders 45. The automated closure jaw section 25 & 27 of the bag filling unit are depicted in greater detail in FIGS. 10, 11 and 14. In the bag filling operation, it is necessary for automated jaws 25 & 27 to rapidly close when the adjustable capacitative sensor 29 senses that the bag is full. Pneumatically air operated cylinders 53 operatively connected to the capacitive sensor 29 and photo electric sensor 33 provide a particularly effective means for respectively rapidly closing and opening the automated jaws 25 & 27.

With reference to the electronic circuitry of the bagging machine 1 as depicted in FIG. 12, the machine 1 may be powered by the 230 kilowatt on-board generator 2 which in turn powers the 5 horse power electrical air compressor 43 (175 psi max 8 gallon tank 15.8 sfm at 125 psi) operationally connected the pneumatic air cylinders 45 which serve to open and close the automatic jaws 25 & 27. Switching of a main control panel MCR starts the cross conveyor motor M-12 to run continuously while also supplying power to the bag heat sealing unit 49. The heat sealing unit 49 is a commercially available off-the-shelf complete unit sold as a sealer hot air model 500, double line seal with extra heat commercially sold and distributed by Hamer, the circuitry of which is designated as IV in FIG. 12. The product level sensor 19 is switched on at limit switch 23 which starts the hopper belt conveyor motor M-4 and the product separator beater motor M-10. As mentioned before, when the product level sensor 19 detects a full product surge in area D, the hopper belt conveyor motor M-4 and the product separator beater motor M-10 are automatically switched off by the circuitry as shown in FIG. 12. The bag filling is reactivated by switching of the photo electric circuitry (see II of FIG. 12) which cause the air cylinders 45 to open the jaws 25 & 27 in area F which occurs upon detecting the placement of an unfilled bag onto the open jaws 25 & 27 by photo electric eye 33. Switching also provides power to the bagger head conveyor motor M-9 and the product leveling auger 11*a* and distribution separating motor M-8. When the adjustable capacitive sensor 29 detects correct product volume in the bag, the bagger header conveyor motor M-9 is switched off, the air cylinders 45 close jaws 25 & 27 to release the bag and the product flow is stopped with a delay relay CRT timer. The bagging machine 1 may be equipped with emergency stop ES located in the bagging area F near the automatic jaws 25 & 27 so as to permit the operator to terminate the power flow to all motors. In operationally use, the hopper 2 of area A is filled with compacted bulk material. When the bagging machine 1 is switched to the running operation, the continuous hopper conveyor 5 slowing advances the compacted bulk material to the product partitioning separator 9 which evenly removes segmented portions of the compacted bulk material from hopper 2 (area C) onto hopper conveyor 5. The product surge zone D continually accepts the segmented portions until full at which time the product level sensor 19 stops the movement of the product partitioning separator beater 9 and the continuous hopper conveyor belt 5 operation. The automatic jaws 25 & 27 are photo electronically activated and when activated, will hold the bag while the bagger header conveyor 15 advances the product to open jaws 25 & 27 and fills the bag. When the adjustable capacitive sensor 29 detects a full bag volume level in the bagging zone F, it switches the bagger head conveyor 15 to the stopped position and the jaws 25 & 27 close. As the jaws 25 & 27 close, the bag is released onto the cross conveyor 55 and the opening of the open bag is run through the bagger heat sealer unit 49 to thermally seal the bag and which then to may be transported to a stacking area.

As mentioned, the electronic circuitry of the bagging machine 1 is disclosed in FIG. 12. The circuitry of FIG. 12 in designated by C.P., II, III, and IV which respectively are the control panel circuitry CP, the photo electric eye circuitry II, the motor powering circuitry III and the heat sealing unit circuitry IV. The electronic circuitry controls the automated operation of the bagging machine 1. The schematic circuitry of FIG. 12 includes a cross reference number identifying the various motors as disclosed in the accompanying drawings. The electrical power is generated by the diesel powered generator 2 transformer T-110 transforms the 230 volt into 115 volt AC current for operation of the electronic circuitry of the control panel circuitry CP and 230 volts for powering the major electrical motors of circuitry III and the internally generated air supply of the air compressor 45. The CP circuitry of FIG. 12 is accordingly generally responsible for the switching motors M-5, M-9, M-12, M-11, M-4 and M-10. The photo electric eye circuitry, sensors 29 & 33, delayed timing, and relays of the depicted circuits of CP serve to operationally switch the electrical motors and the valving of air cylinders 45.

When the operator switches the power "on" button of the master controls MCR, the electronic circuity respectively starts motor M-10 which powers the leveling auger 11*a* and product distribution beater 13 motor M-10 for powering the partitioning segmenting beater 9 and the powering of the cross conveyor 55 by motor M-12, the latter of which runs continuously until manually switched off. The adjustable product level sensor 19, as mentioned earlier, physically senses when the leveling auger 11*a* and beater 13 are filled to the detecting fill level of zone D which, in turn, switches off the partitioning motor (M-10) and bin box conveyor motor (M-5). When the photo electric sensor 33 senses placement of an unfilled bag onto jaws 25 & 27, it transmits an electronic signal through the electronic circuitry to engage motor M-9, and when a filled bag is subsequently detected, capacitive sensor 29 transmits a signal to switch off motor M-9. Although, commencement of bag filling may be manually activated by activating a manual switch positioned near the automatic jaws 25 & 27, the opening of the jaws 25 & 27 for bag filling is best conducted by photo electric beam (33) similar to garage door sensor which senses the beam interruption by placement of an unfilled bag thereto which promptly activates air cylinders 45 to open jaws 25 & 27. When triggered by the adjustable capacitive sensor 29, motor M-9 (bagger header conveyor 5) stops and the air cylinders 45 close jaws 25 & 27. An emergency stop push button (switch ES) located near the automatic jaws 25 & 27 allows the operator to immediately stop the power flow to all motors and the filling operation of the bagging machine 1.

The preferred embodiments of the invention of the bag density fill sensor 29 senses the density or fill of the bulk materials within the bag. The adjustable capacitive sensor 29 may be appropriately adjusted upwardly or downwardly as may be seen in FIG. 10 to accommodate the desired bag fill. Accordingly, the operator will preset the bag fill sensor 29 to the appropriate vertical height of bag fill and the bag fill sensor 29 will then thereafter determine when the bag is filled to the appropriate bag fill level, at which time the sensor 29 transmits a signal to the electric circuitry to close the automatic jaws 25 & 27 and stop the motor of the bagger head conveyor 5. A particularly effective adjustable capacitive sensor 29 is manufactured by Pepperl & Fuchs as Model No. CJ40-FP-W-P4. Alternatively, load cells may also be used to determine the level of bag fill and stop the bag filling when the desired level of fill is achieved.

The bagging machine 1 electronic circuitry of FIG. 12 discloses the schematic circuitry of the 120 AC volt regulatory circuitry of CP, the 24 volt DC circuitry II for powering photo electronic eye 33, the 230 volt AC circuitry III for powering motors M-5, M-9, M-12, M-11, M-4 and M-10 and the commercially available heat sealing unit 49 of the bagging unit 17 generally designated as circuitry IV. The major motors, namely the hopper conveyor motor M-5, the bagger head conveyor motor M-9, the cross bag conveyor motor M-12, the product beater separator motor M-10, the product leveling and agitator auger motor M-11 and a rear axle hydraulic cylinder leveling motors M-4 are all powered by the 230 volt power supply of circuitry III but are generally regulated by a control panel circuitry CP. As may be observed from FIG. 12, the 230 volt generator 2 provides the current source for powering motors M-5, M-9, M-12, M-11, M-4 and M-10 which appropriately flows through protective fuses onto the respective motors when appropriately switched on by the 120 volt AC control power switching panel of schematic circuitry designated by CP.

Figure 2:
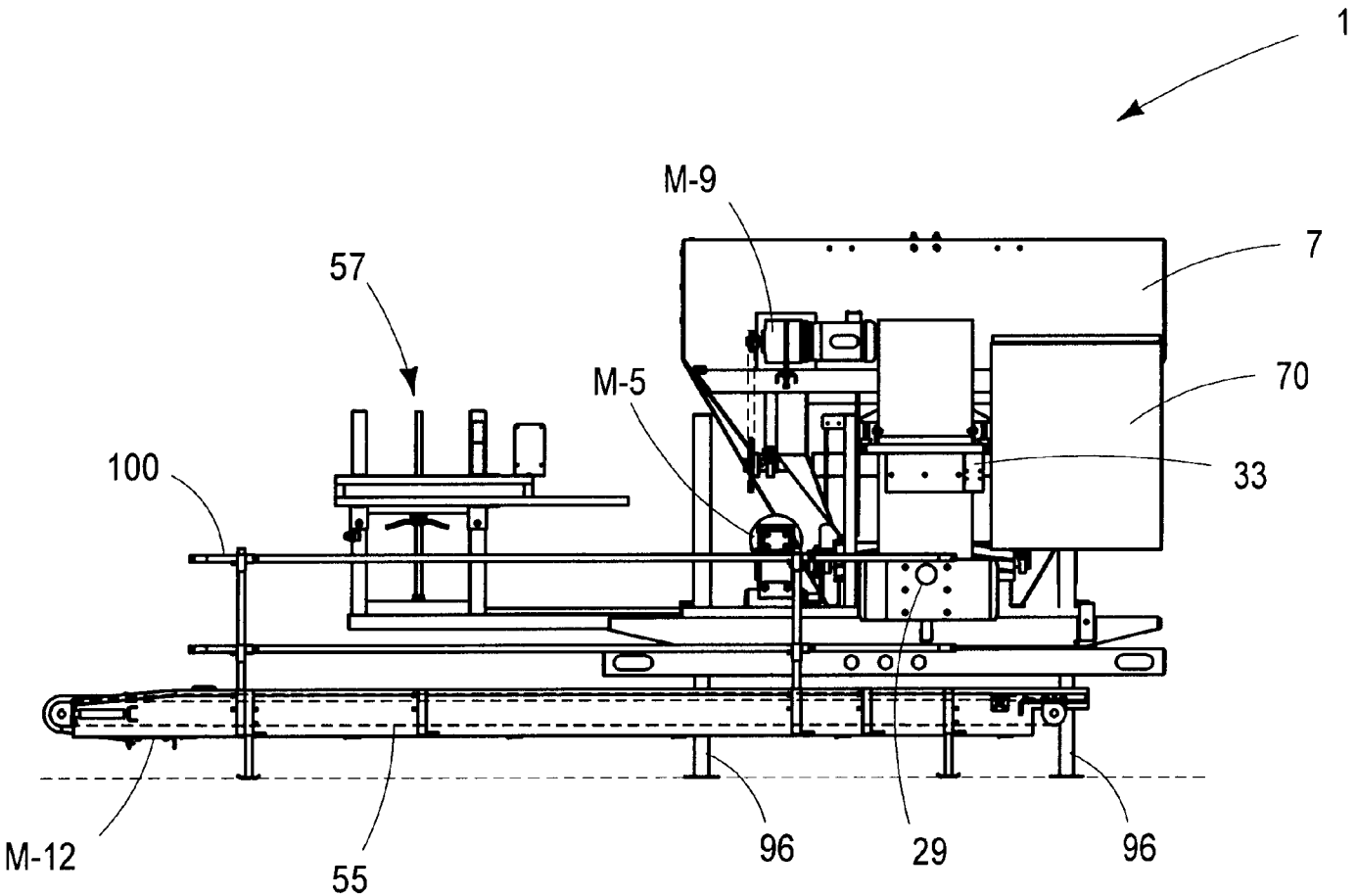
FIG. 2 is a rear view of the bagging machine of FIG. 1.

When the bagging machine 1 is deployed to an off-site or remote bagging site, the bagging machine 1 need not be unhitched from the towing vehicle (V) since the trailer 40 is advantageously equipped with hydraulic driven leveling legs 96, the motor and drive cylinder supported by legs 99 of which is as partially shown in FIGS. 1, 2 and 4. The bagging machine 1 is accordingly best placed in operational condition by initially leveling the bagging machine. This is accomplished by switching the hydraulic leveling motor M-4 by switching on the switch S-4 and circuit relay CR-4 of control panel CP to activate the leveling system.

Commencing of the bulk material feed supply for the bagging operation begins with the switching of switch MRC which switches power to the bagger cross conveyor motor M-12 which runs the bagger cross conveyor 59 continuously (unless switched off by switches ES or MCR) the leveling auger beater motor M-10 and the product separator beater motor M-11. The hopper conveyor motor M-5 is switched, the adjustable capacitative sensor 29 and the conveyor bagger header motor M-9 are then engaged.

With further reference to the designated elements of circuitry of FIG. 12, the emergency switches ES (remote and panel) are normally closed unless switched off with the MCR which represents the master control relay. Each of the control relays suffixed with a number represent current relays for switching power to the 230 volt motors with the CR-5, CR-9, CR-12, CR-11 and CR-10 and CR-4 respectively represents circuit relay breaker for motors M-5, M-9, M-12, M-11, M-4 and M-10. The integration of the bag fill sensor 29 and load level sensor switch 23 are shown in the CP circuitry. Also shown is a circuity relay for a digital bag count CR-B and the air blower switching CRT of the heat sealing unit. The SJ designation regulates the air cylinders for jaws 25 & 27. Switches S-1, S-2, S-3 and S-4 represent control panel switches for the CP circuitry which are appropriately switched for the operational running of machine 1.

Power to the control panel circuitry CP is switched on as indicated by a lighted pilot light PL when the two emergency stop switches and the master relay switch MCR are closed to provide power to the instrument panel 70. This will commence the operative control of hopper conveyor motor M-5 which when the hopper stop switch S1 and hopper start switch S1 are closed, the current flow closes current relay CR-5 and power fault contact on variable drive for motor M-5. The bagger head conveyor motor M-9 of CR-9 are closed by photo eye 33, power to normally closed capacitive sensor 29, power to CR-9 closes the circuit to power M-9 and closing of circuit relay CR-10 switches power on for motor M-10. The system stop switch S-3 and system start switch S-4 regulate power to CR-12 for starting motor M-12. When the CR-5 relay is closed current flows to switch CR-10 for starting Motor M-10, Switch S-4 starts and stops the current relay CR-4 for motor M-4 to level machine 1.

The photo electric circuitry II of FIG. 12 converts the 230 volt AC current with voltage converter T24 onto 24 DC current for operating the phone electric eye 33 which triggers the switching on of the conveyor bagger motor M-9 and the opening of jaws 25 & 27 via air cylinder 45 through CP circuitry.

In the region designated as circuitry IV of FIG. 12, the controls for the operation of bag heat sealing 49 is disclosed. Bag heat sealing units 49 of the typed used herein and depicted by the circuitry of IV may be obtained from commercial suppliers. The units are typically equipped with laterally disposed heat sealing mandrels or elements 82 & 84 through which the unsealed bag end opening are passed through to thermaplastically seal the bag. The heat sealing bagging unit 49 is equipped with a one-half(½) horse power electrical motor 86 which serves to power a pair of laterally positioned continuous belts 88 which (after the closure portion of bag heated to double melted seam by mandrels 82 & 84 compressively grip and seal together) and convey the bag at a constant preset speed. The hot sealed seams are allowed to cool to permanently seal the bag. The sealed bags are then ready for stacking and shipment.

Electrial power may be advantageously supplied by onboard 20 KW generator 2, powering a 5 hp air compressor 47 (175 max PSI, 8 gal Tank, 14.8 CFM@ 125 psi) operatively connected to pneumatic cylinders 45 for opening and closing automatic jaws 25 & 27. The main power switch MCR is switched on which starts and continuously runs cross conveyor motor M-12. Power is then supplied to bag sealer 49. The product level sensor switch 23 at CP limit switch 23 which starts hopper belt conveyor 5 and motor M-10 for product separator beater 9. When the product level sensor 19 detects a full product surge area (area D), motor M-5 of the hopper conveyor 5 and motor M-11 of the product separators 9 are stopped. Bag filling is activated by switching on automatic jaws (area F) which air cylinders open jaws (area F) motor M-9 for bagger head conveyor 5 (area G) and motor M-10 produced leveling auger 11 and beater 13 are started. Bag filling stops when adjustable capacitive sensor 29 detects predetermined product volume level in the bag. When triggered, motor M-9 (bagger head conveyor 5) stops, air cylinders 45 close jaws 25 & 27, (area F) and motor M-10 of produce level auger 11 and beater 13 is stopped with a delay timer. Emergency stops; push buttons located near automatic jaws (area F) stops power flow to all motors.

Although the bagging machine 1 may embody a variety of different types of machinery to perform substantially the same functions to achieve substantially the same end result, the following listed components with cross-referenced indexing (items) to the drawing (where applicable) have been found to be particularly useful in providing the bagging machine as depicted in the figures.

Illustrate Equipment

Chain—60 H
Sprocket 60 H Chain, 13 Teeth, 1-¼" Bore
Gearbox Worn Reducer 2.62 C, 20:1
ELVM3558 Motor—2 hp, 1725 RPM, PH-3, volt 208-230-460
Sprocket 60 h Chain, 22 teeth, 1-¼" bore
Electric Motor ½ HP Single Phase, 203V–460V, 60 HZ
Generator 20KW Diesel Generator Set, No 100 amp breaker
Belt Bagger 30"×35" 2 ply ⅛"×1/16"
Construction Grade Air Compressor, 175 max PSI, 8 gal Tank, 14.8 CFM@ 125 PSI, 5 HP, IT
Hydraulic Power Unit 1HP AC Power Unit
Gearbox Drive with electric 120VAC Motor
Belt, Paddle 16"×20" 2 ply 1/32"×1/32"
Sensor Capacitive Classic Series Sensor #CJ40FPWP4
Gearbox Drives with Electric 120 VAC Motor
Belt Bagger 12"×40" 2 Ply 1/32"×1/32"
Sealer Hot Air Model 500, Double Line Seal & Extra Heat manufactured and distributed by Hamer.

A more detailed itemization of the source and type of electronic components with reference to the FIG. 12 schematic circuitry may be found as appendix A, exhibits A-1 through A-26 inclusive of Provisional Application No. 0/338,403 referenced above. A similar listing and legend for the mechanical components are described in Figures corresponding to the Figures of this non-provisional, application.

The bagging machine 1 includes other features which enhance its use by operators. Notwithstanding, the through shaped funneling of bin 3 onto lengthwise bottom conveyor 5, the unprocessed bulk material (which lacks the enhanced free-flowing attributes) will often bridge abase the bottom conveyor 5 requiring a manual breaking of the bridged bulk material so that it falls onto the bottom conveyor 5 for transport. A vertical curtain 92 (e.g. plastic) suspended lengthwise from supporting rods 94 and extending downwardly to a position slightly above the bottom conveyor 5 will prevent bridging and allow the bulk material to fall onto the bottom conveyor for transport. The cross-conveyor belt 55 and associated equipment is too wide for highway transport. The cross-conveyor assembly includes mounts (not shown) for mounting and dismounting the cross-conveyor assembly for transport and carriage upon the carrying pods 90 shown in FIG. 4. The adjustable features of the bagging heat sealing element to bag size, the capacitive sensor 29, the photo eye 33 and hand rails are shown but undesignated. A bag holding tray BH provides a readily accessible site for providing bags to the bagging unit 49.

What is claimed is:

1. A bagging machine for converting bulk materials into a more uniform free-flowing and baggable product, said bagging machine comprising:

a) a bin for retaining bulk materials, b) a bottom bin conveyor for advancing the bulk materials to a bin discharge end, c) a partitioning separator positioned at a discharge end of the bottom bin conveyor for partitioning the bulk material advancing upon said bottom bin conveyor into segmented portions, d) a separating beater positioned in a surge zone for separating the segmented portions discharged from the bottom conveyor into a separated material possessing enhanced flow characteristics, e) a conveyor leveling member for uniformly distributing the separated material onto a bagger conveyor for transporting the uniformly distributed beaten material for bagging, and f) a bagging unit for receiving the uniformly distributed separated material from the bagger conveyor and bagging the separated material in a bag.

2. The bagging machine according to claim 1 wherein the surge zone includes a product level sensor for sensing excessive levels of the segmented portions within the surge zone.

3. The bagging machine according to claim 2 wherein the product level sensor is operationally connected to a switch for stopping the advance of bulk materials by said bottom bin conveyor when the product level sensor senses the excessive levels of the segmented portions.

4. The bagging machine according to claim 2 wherein the switch for stopping the bottom bin conveyor also stops the partitioning separator.

5. The bagging machine according to claim 4 wherein the product level sensor switches the bottom bin conveyor and the partitioning separator to an operative mode when the product level sensor detects an absence of the excessive levels of the segmented portions in the surge zone.

6. The bagging machine according to claim 1 wherein the bagging unit includes a bagging chute terminated by a pair of laterally disposed jaw members which when positioned in a closed position serve as a valve to stop the flow of separated material therethrough and when placed in an open position serve to retain an unfilled bag in a filling position and allow filling of the bag.

7. The bagging machine according to claim 6 wherein the bagging unit includes a bag fill sensor which senses when the unfilled bag attains a desired level of bag fill and transmits an electronic signal to activate closure of the jaw members to the closed position.

8. The bagging machine according to claim 7 wherein the electronic signal transmitted by the bag fill sensor includes a signal to switch the bagger conveyor to an off position and thereby stop the transporting of the separated material to a bagging chute.

9. The bagging machine according to claim 8 wherein the bagging unit includes a photo electric eye juxtopositioned near the jaw members for sensing when a newly positioned unfilled bag is positioned about the jaw members and emitting an electronic command to switch the jaw members to the open position.

10. The bagging machine according to claim 9 wherein the electronic command also switches the bagger conveyor to an operative mode.

11. A bagging method for bagging a flow of bulk feed materials of a substantially uniform bagging consistency from a compacted bulk material, said method comprising:

a) segmenting the compacted bulk material into segmented portions, b) subjecting the segmented portions to a separating action to provide a separated material possessing enhanced flow characteristics.

c) uniformly distributing the beaten material upon a bagger conveyor for conveyance to a bagging unit, and d) bagging the uniformly distributed separated material in a bag.

12. The bagging method according to claim 11 wherein the subjecting of the segmented portions to the separating action comprises striking the segmented portions with a separating beater equipped with toothed projections radially moving about an axis positionally disposed so as to outwardly beat against the segmented portions fed onto the toothed projections.

13. The bagging method according to claim 12 which includes allowing the segmented portions to gravitationally flow onto the separating action.

14. The bagging method according to claim 12 which includes a bagging machine equipped with a product level sensor for detecting an excessive surge of segmented portions within a surge zone housing the separating beater for beating the segmented portions, said method comprising an additional step of detecting the excessive surge of segmented portions to said surge zone and a relaying of an electronic signal to terminate a flow of the segmented portions into the surge zone.

15. The bagging method according to claim 14 wherein the detecting includes a relaying of an electronic signal to commence the flow of segmented portions into the surge zone when the product level sensor detects an absence of the excessive segmented portions within said surge zone.

16. The method according to claim 12 which includes a bagging machine equipped with a leveling auger for uniformly distributing the separated material upon the bagger conveyor, said leveling auger sharing a common axle drive with said separator beater, said method comprising engaging the common axle drive so as to permit the beater to rotationally beat the segmented portions into the separated material while simultaneously allowing the leveling auger to rotationally and uniformly level the beaten material onto the bagger conveyor.

17. The bagging method according to claim 11 wherein a bagging machine used in the bagging method includes an adjustable capacitive sensor for sensing bag fill and transmitting an electronic signal to stop the conveyance of the uniformly distributed separated material upon the bagger conveyor when the adjustable capacitive sensor senses the bag filled to a predetermined level of fill, said method comprising:

a) adjusting the adjustable capacitive sensor to the predetermined level of fill, and b) allowing the bag to be filled to the predetermined level of fill and the transmitting of the electronic signal to stop the conveyance of the uniformly distributed separated material upon the bagger conveyor to said bagging unit.

18. The bagging method according to claim 17 wherein the method includes manually replacing the bag filled to the predetermined level with an unfilled bag and restarting the flow of feed materials so as to allow the unfilled bag to be filled to predetermined level of fill.

19. The method according to claim 18 wherein the machine includes a photo electric sensor for sensing placement of an unfilled bag upon a pair of laterally disposed jaw members for receiving the uniformly separated material from a bagging material chute, with the jaw members serving to stop the flow of uniformly separated material when placed in a closed position and to allow for the filling of a bag and retaining of the unfilled bag in a filling position when positioned in an open position and electronic circuitry for causing the jaw members to be placed in the open position when sensing the placement of the unfilled bag upon said jaw members, the method of which includes the step of placing the unfilled bag upon the jaw members to cause the photo electric sensor to sense the placement of unfilled bag thereupon and thereby activate the electronic circuitry to place the jaw members in the open position.

20. The method according to claim 11 wherein the partitioning separator comprises a plurality of legged appendages equipped with feet having distal separating edges powered about rotating radi passing through mating apertures at the bin discharge end of a holding bin holding compacted bulk material, and the method includes rotating the legged appendages through the mating apertures to cause the separating edges to separate the compacted bulk material being conveyed thereto by a bin conveyor into the segmented portions and depositing the segmented portions onto a bottom conveyor for conveyance to the surge zone.

* * * * *